United States Patent [19]

Gustav et al.

[11] Patent Number: 4,938,150

[45] Date of Patent: Jul. 3, 1990

[54] GUIDE AND SUPPORT TRACK SYSTEM

[75] Inventors: Rackowitsch Gustav, Dortmund; Grapetin Manfred, Herdecke; Spöler Johannes-Gerhard, Borken, all of Fed. Rep. of Germany

[73] Assignee: Mannesmann Aktiengessellschaft, Dusseldorf, Fed. Rep. of Germany

[21] Appl. No.: 308,144

[22] Filed: Feb. 8, 1989

[30] Foreign Application Priority Data

Feb. 19, 1988 [DE] Fed. Rep. of Germany ..... 3805617

[51] Int. Cl.[5] ..... F01B 25/06

[52] U.S. Cl. ..... 104/130; 104/102

[58] Field of Search ..... 104/131, 130, 102; 238/151; 246/301, 311, 336, 339, 346, 392, 418, 422, 430, 431, 432

[56] References Cited

FOREIGN PATENT DOCUMENTS 2438186 5/1975 Fed. Rep. of Germany ..... 104/130

417435 2/1967 Switzerland ..... 104/130

*Primary Examiner*—Andres Kashnikow

*Assistant Examiner*—Virna Lissi Mojica

*Attorney, Agent, or Firm*—Cohen, Pontani & Liberman

[57] ABSTRACT

In a switch, a straight rail section (3) is movable with respect to a stationary rail (1). The straight rail section (3) is connected via a bracket (5) to a movable switch base plate (6) which is guided by travel wheels (7) in travel or running rails (12) and by guide rollers (8) in guide rails (13) of lateral profiled sections (9). The lateral profiled sections are connected to each other by intermediate profiled sections (11) forming a support plate (10).

15 Claims, 3 Drawing Sheets

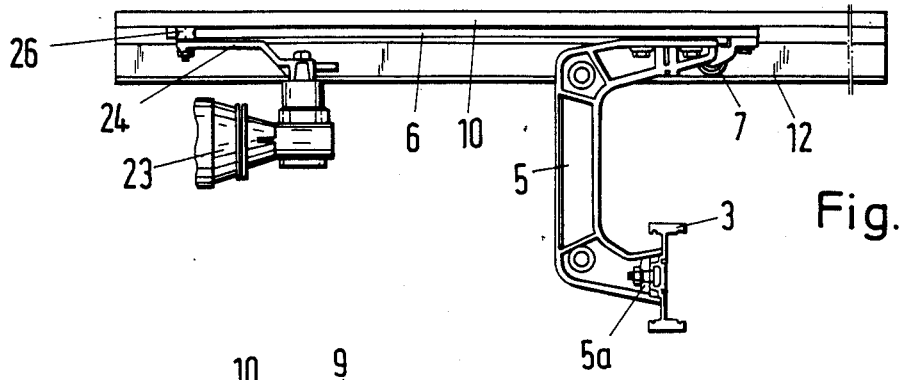
Fig. 5
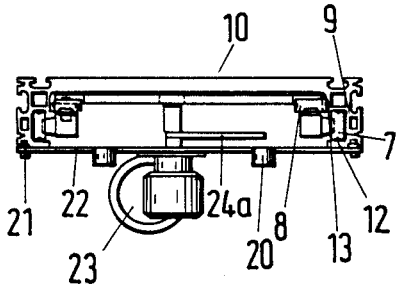
Fig. 6
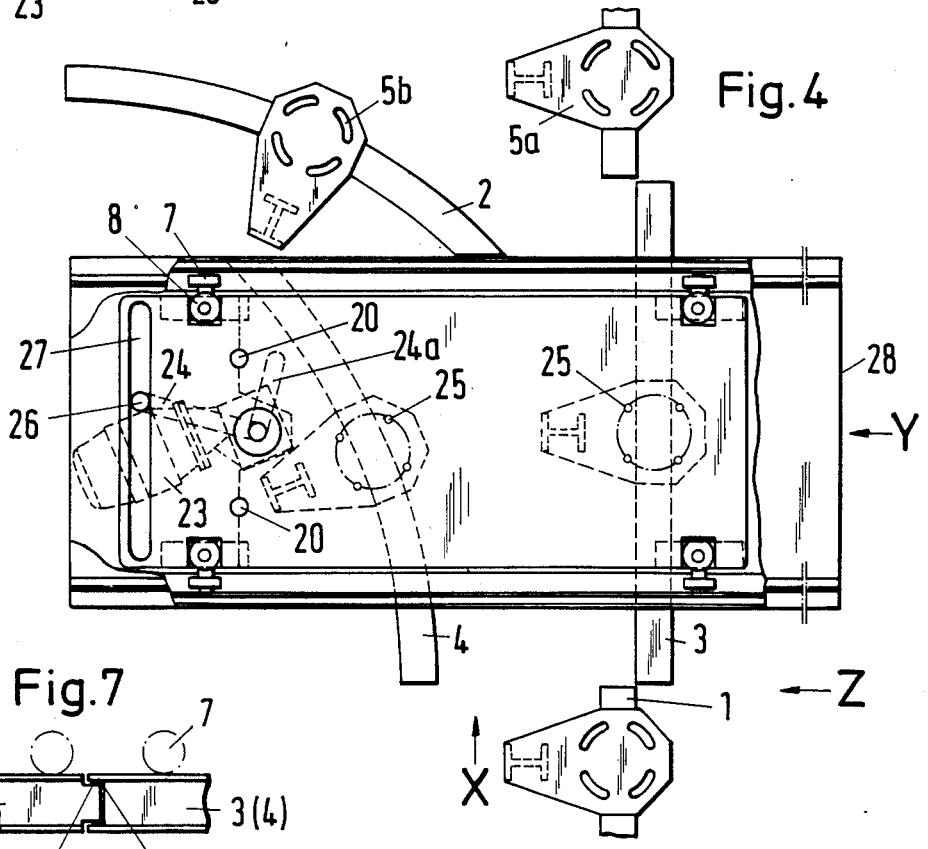
Fig. 4
Fig. 7
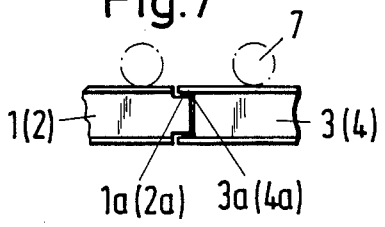

GUIDE AND SUPPORT TRACK SYSTEM

FIELD OF THE INVENTION

The present invention relates to a guide and support track system and more specifically to a system wherein the travel rail and guide rail are integral parts of lateral profiled sections which are connected together by intermediate profiled sections provided with protrusions and recesses.

BACKGROUND OF THE INVENTION

In an arrangement developed as a switch in accordance with Federal Republic of Germany Patent No. 3,802,265, both a stationary plate and a switch base plate are provided as a frame with longitudinal and transverse girders and are therefore expensive to manufacture. This manner of construction is also customary in hoisting and lowering stations, as shown by Federal Republic of Germany Patent No. 3,241,744.

SUMMARY OF THE INVENTION

The object of the present invention is therefore to provide a simple guide and support track assembly of the type indicated above and to develop the system in such a manner that the same basic construction can be used for a plurality of very different uses. This object is achieved in that the travel rails or running rails and guide rails for the travel wheels and guide rollers are integral parts of lateral profiled sections which are connected to each other to form a stationary intermediate plate via intermediate profiled sections which are provided with projections and recesses. The intermediate profiled sections are commercially available rectangular hollow profiles and therefore extremely economical as mass-produced articles and replace the frame heretofore customarily used. Depending on the required width, a different number of intermediate profiled sections can be used for different applications. The plate forms a stable unit resistant to torsional and flexional deformations.

In accordance with another feature of the invention, the lateral profiled sections of the stationary intermediate plate have insertion grooves for bolts with which the intermediate plate is fastened to the support structure. The plate is particularly stable when bolted in place and it withstands all stresses, particularly upon assembly, without requiring the previously customary frame. The intermediate profiled sections are flat rectangular hollow profiled sections and are connected to each other by projections which are angled off and engage as force fit in grooves located in the lateral webs. The attachment can also be effected by spot welding points to produce a connection which is flexionally rigid. The bolts inserted into the insertion grooves are guided by claws which rest on the flanges of the support structure. The plates are formed as toothed plates of variable length and permit the plate arrangement on an oblique support structure and thus compensate for the changes in spacing caused by the different oblique positions of the bolts lying alongside the flanges of different width. On abatement of the initial tension of the bolts, the toothed plate prevent the claws from sliding off the flanges.

In a further embodiment of the invention, the travel or running wheels and guide rollers are mounted on a displaceable base plate having brackets for rail sections fastened thereto. In the case of switches, only one bracket for each rail section is arranged in its longitudinal center; it resting with a bracket foot against the switch base plate. Due to the us of only one bracket a large passage or transfer profile is produced. The bracket foot has slots in the shape of a circular segment for the attachment bolts, the slots permitting a swinging of the brackets with respect to the switch base plate. The single center bracket is sufficient even for heavy suspension-rail vehicles since the ends of the stationary straight rails and of the branch rails have a resting surface for support surfaces at the ends of the rail sections which can be placed thereon so that the structure is not subjected to the load of the suspension rail since its weight is transmitted to the stationary rails.

The gearing necessary for the movement of the displaceable part can be actuated by motor or a hand crank. Manual actuation is advantageous, in particular, during assembly and upon inspections. An angle lever activating cut-off switches which disconnect the drive when the end position is reached can be associated with the gearing.

The guide and support track system of the invention is suitable also for very simple assembly conveyor systems. The lateral profiled sections are then arranged horizontally one above the other and the displacement plate, which is then vertical, can have a horizontal support plate for goods to be transported. The guide and support system can also be used for a hoisting and lowering station within conveyor systems. The lateral profiled sections are then arranged vertically and a rail section which is displaceable between the stationary rails can be fastened on the switch base plate. The bottom side or rear wall of the displaceable part can be covered by a protective plate.

BRIEF DESCRIPTION OF THE DRAWINGS

Various embodiments of the invention are explained hereinafter and shown in the drawings, in which:

FIG. 4 is a top plan view of a switch shown in FIG. 1;

FIG. 5 is a side view of the switch of FIG. 4, viewed from the direction X in FIG. 4;

FIG. 6 is an end view of the switch of FIG. 4, taken from the direction Y (without the end plate) in FIG. 4;

FIG. 7 shows the ends of rail and rail section, viewed in the direction Z in FIG. 4;

DETAILED DESCRIPTION OF A PRESENTLY PREFERRED EMBODIMENT

Figure 1:
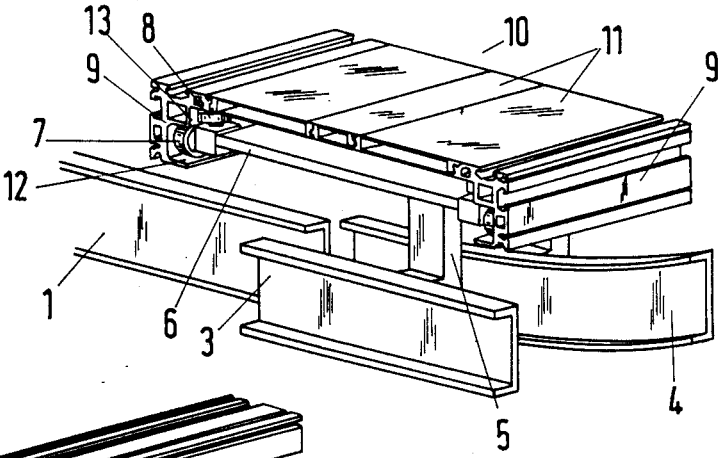
FIGS. 1 to 3 show guide and support tracks for switches of a suspended conveyor system, a simple assembly conveyor path, and a hoisting and lowering station of a suspended conveyor

FIG. 1 is a perspective view of a switch which has been partially displaced. A straight rail section 3 has been shifted somewhat with respect to the straight stationary rail 1. The curved rail section 4 has not yet reached the position of connection to the straight rail. The straight rail section 3 is connected via a bracket 5 to a switch base plate 6 which is guided by travel wheels 7 in travel or running rails 12 and by guide rollers in guide rails 13 of a lateral profiled section 9. The latter is connected via three intermediate profiled sections 11 to form a support plate 10.

Figure 2:
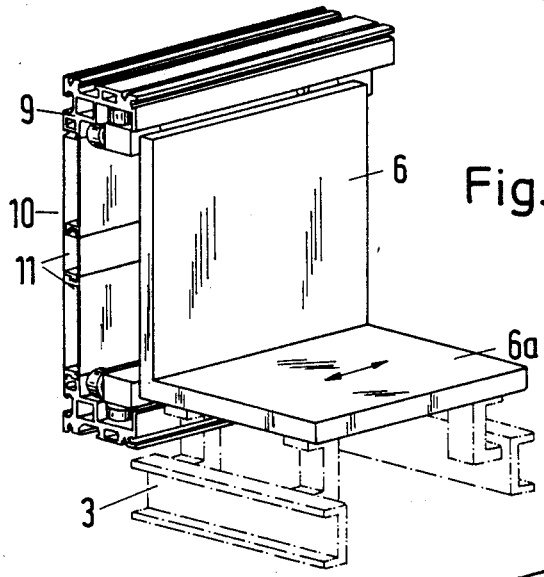

In the transverse-displacement arrangement of FIG. 2, profiled sections 9 and the support plate 10, which is formed of the profiled sections 11, are arranged so that the travel rails and guide rails are horizontal and permit a lateral shifting of the switch base plate 6 with its support plate 6a for goods. This arrangement is suitable as a short assembly conveyor system, the support plate 6a forming a leg-free work table, and the switch base plate 6 being displaceable horizontally on the support plate 10 for connection to horizontal stationary rails. The base plate 6 (or support plate 6a) is provided with straight rail sections 3, as indicated by dot-dash lines.

Figure 3:
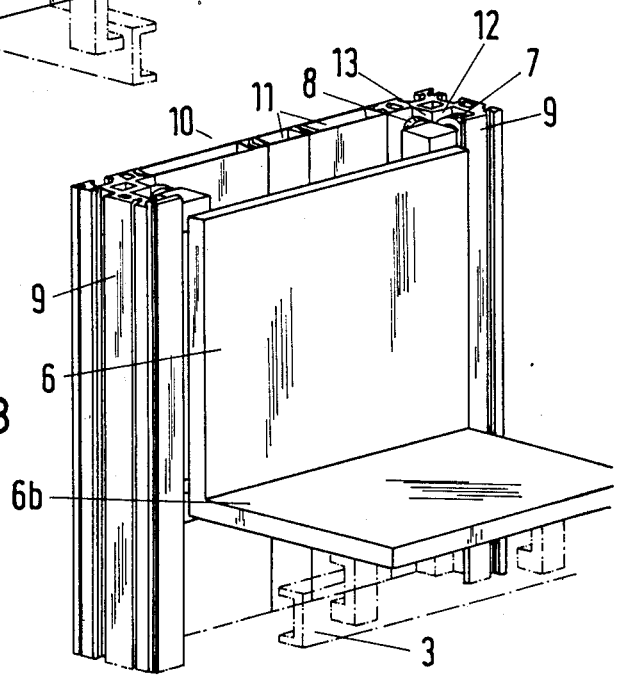

In accordance with FIG. 3, the same profiled sections 9 and 11 of the support plate 10 are arranged vertically and are suitable for the lifting and lowering of the switch base plate 6 with travel wheels 7 in travel or running rails 12 and guide rollers 8 in guide rails 13 of the lateral profiled section 9. A support plate fastened to the switch base plate 6 then serves as a bracket 6b for a straight rail section 3, indicated by dot-dash lines, which can be inserted between stationary rails (not shown) arranged at different heights.

FIG. 4 shows a switch with the opposed, spaced apart ends of two stationary straight rail sections 1 and a straight rail section 3 displaceably connecting the spaced part ends for passage or transfer of objects to be moved through the switch. Over the curved rail section 4 of the switch a stationary branch rail section 2 leads to the adjoining stationary straight rail 1. As shown in FIG. 7, the movable or displaceable rail sections 3 and 4 lie in the passage or transfer position with support surfaces 3a (4a) on resting surfaces 1a (2a) of the rails (1 and 2) and are fastened in each case via a bracket 5 to a switch base plate 6. In order to permit the swinging of the brackets 5, their bracket feet 5c are provided with slots 5b in the shape of circular segments for bolts 25. The slots extend in each case over an angle of about 45 degrees so that the brackets 5, as can be noted from FIG. 4, can be turned so as to compensate for tolerances at low cost. Each bracket has a support plate 5a (FIG. 5) for the respective rail section 3, 4.

Figure 9:
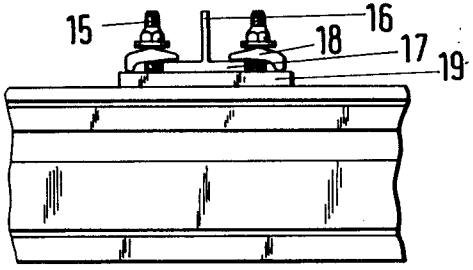
FIG. 9 is an end view of the intermediate plate of FIG. 8.
Figure 11:
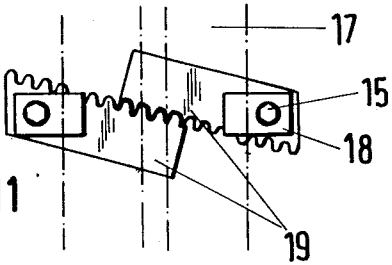
FIG. 11 is a top plan view of the bolt arrangement according to FIG. 9.
Figure 8:
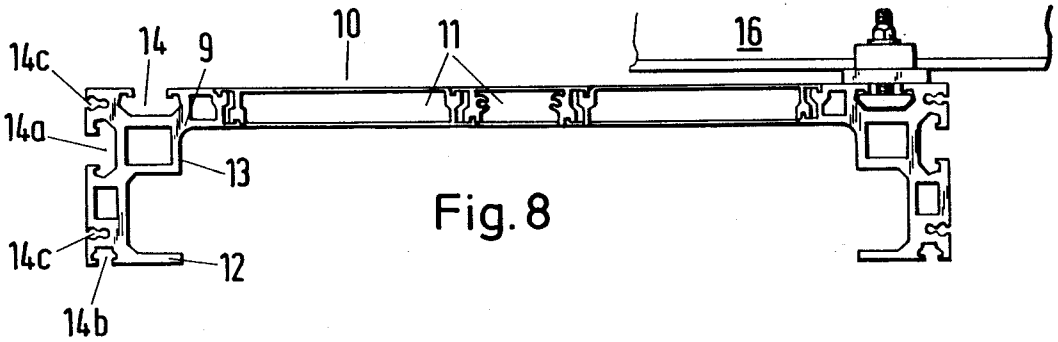
FIG. 8 is a cross-section through the intermediate plate, with suspension as shown in any of FIGS 1–3.
Figure 10:
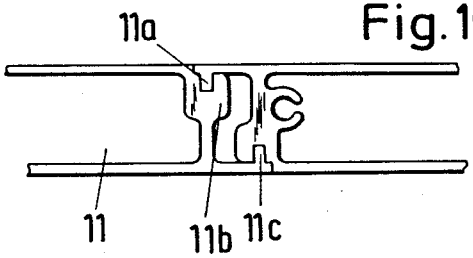
FIG. 10 shows a portion of FIG. 8 on a larger scale.
Figure 12:
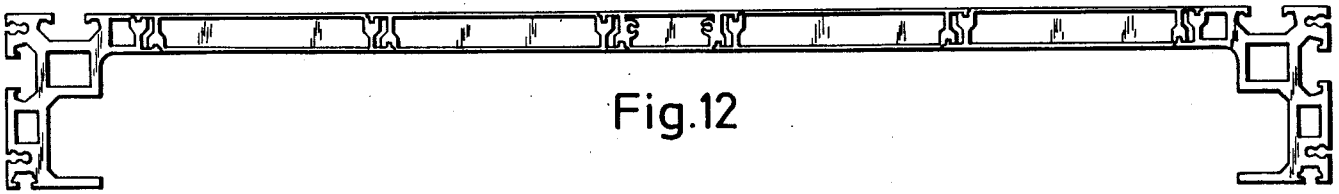
FIG. 12 is a cross-section through a different plate arrangement.

Support plate 10 is also formed of two lateral profiled sections 9 and one or more intermediate profiled sections 11 positioned between them, the sections 11 being connected to each other via projections 11a and recesses 11c located in side webs 11b and being also connected in this manner to the lateral profiled sections 9, as shown in FIGS. 8, 10 and 12. Each lateral profiled section 9 has a horizontal travel or running rail 12 for the travel wheels 7 and a vertical guide rail 13 for the guide rollers 8, as well as upper and lateral insertion grooves 14 and 14a for the heads of bolts 15 by which the sections 9 are attached to the support structure 16. Since the latter is generally formed of I-beams, the lower flanges 17 are gripped by claws 18 through which the bolts 15 extend (FIG. 9). When the support structures extend generally at right angles or oblique to the lateral profiled sections 9, the bolts 15 for effecting the attachment are inserted into the upper insertion groove 14 and held apart by a pair of toothed plates 19. By varying the respective displacements of the toothed plates the correct distance between the bolts is obtained, as shown in FIG. 11.

Any resulting differences in height may be compensated for by locknuts or shims of appropriate thickness.

The lateral profiled sections 9 also have lower insertion grooves 14b for bolts 21 which bear a transverse girder developed as a protective plate 22 for a reversible motor 23 (FIG. 6). The latter operatively shifts the switch base plate 6, together with the rail sections 3 and 4, via a gearing shown in FIGS. 4 and 5. The gearing has a lever 24 with a drive roller 26 which engages in a slot 27 in the switch base plate 6 and displaces the latter. Upon swinging, lever arm 24a which is rigidly connected to lever 24 reaches one of the two cut-off switches 20, thereby enabling attainment of great precision of adjustment. The cut-off switches 20 are mounted in protective plate 22 so as to prevent a dangerous and unintended reaching into the region of the lever gearing. The front side of the displaceable part ma be covered in all embodiments by end plates 28. The lateral profiled section 9 furthermore has small lateral insertion grooves 14c for housing electric cables.

It should be understood that the preferred embodiments described above are for illustrative purposes only and are not to be construed as limiting the scope of the invention which is properly delineated in the appended claims.

What is claimed is:

1. A guide and support track system comprising:

a stationary rail section;

a movable rail section;

a base plate (6) carrying said movable rail section and movable between a first position in which said movable rail section is aligned with said stationary rail section and a second position in which said movable rail section is displaced out of alignment with said stationary rail section;

a lateral profiled section (9) forming a stationary running rail and a guide rail for guiding said base plate between said first and second positions; and an intermediate profiled section (11), said lateral and intermediate profiled sections having mutually engageable protrusions (11a) and recesses (11c) for connecting said lateral and intermediate sections to form a stationary support plate (10).

2. The system of claim 1, further comprising a support structure (16); fastening members (15); and insertion grooves (14) defined in said lateral profiled section (9) for mounting said profiled section with said fastening members (15) to said support structure (16).

3. The system of claim 1, wherein the stationary support plate (10) comprises a plurality of intermediate profiled sections (11), said intermediate profiled sections being formed by flat rectangular hollow sections connected to each other and to said lateral profiled section by respective opposing protrusions (11a) projecting at an angle from opposed extensions of the lateral and intermediate sections toward the inside thereof for mating engagement with opposed recesses (11c) provided in lateral webs (11b) projecting from said intermediate and lateral sections.

4. The system of claim 2, further comprising claws (18) for guiding said fastening members (15) inserted into said grooves (14, 14a) of said lateral profiled section; and flanges (17) on said support structure (16) for supporting said claws.

5. The system of claim 4, further comprising toothed guide plates (19) for guiding said fastening members (15); said guide plates being longitudinally displaceable with respect to each other.

6. The system of claim 1, further comprising travel wheels (7) and guide rollers (8) on said base plate and movably engaging said running rail and said guide rail; and brackets (5) on said base plate for securing said movable rail section to said base plate.

7. The system of claim 1, wherein said movable rail section is a straight rail section, and the system further comprising:

a movable curved rail section (4) carried on said base plate (6); and brackets (5), and having a bracket foot (5c) at one end thereof for mounting said bracket to said base plate and a support plate (5a) at the other end thereof for lateral attachment to the longitudinal center of said respective straight rail section (3) and curved rail section (4).

8. The system of claim 7, wherein said bracket foot (5c) further comprises a slot (5b) having the shape of a circular segment for attachment of said bracket to said base plate by an attachment bolt (25).

9. The system of claim 7, additionally comprising a resting surface (1a) at the end of said stationary rail section (1); and support surfaces (3a, 4a) at the ends of the movable rail sections (3, 4) for aligned engagement with said stationary rail resting surfaces.

10. The system of claim 1, additionally comprising a motor and gearing operable for moving said base plate between said first and second positions.

11. The system of claim 1, further comprising a hand crank operable for moving said base plate between said first and second positions.

12. The system of claim 10, additionally comprising a cut-off switch; and a lever operatively connected to said gearing for actuating said cut-off switch thereby controlling the movement of said base plate.

13. The system of claim 1, wherein the lateral profiled section (9) is arranged horizontally and the base plate (6) extends in a vertical direction, and additionally comprising a horizontal support plate (6a) connected to the base plate and movable therewith for supporting goods to be transported.

14. The system of claim 1, wherein the lateral profiled section (9) is arranged vertically and the movable rail section (3) is mounted to said base plate.

15. The system of claim 1, additionally comprising a protective plate (22) mounted to the lateral profiled section (9) opposite said support plate (10).

* * * * *